US011547205B2

(12) United States Patent
Maynes

(10) Patent No.: US 11,547,205 B2
(45) Date of Patent: Jan. 10, 2023

(54) COLLAPSIBLE MEASURING AND CUTTING CRAFT TABLE

(71) Applicant: Studio Designs, Inc., Commerce, CA (US)

(72) Inventor: Scott Maynes, Commerce, CA (US)

( * ) Notice: Subject to any disclaimer, the term of this patent is extended or adjusted under 35 U.S.C. 154(b) by 65 days.

(21) Appl. No.: 17/103,930

(22) Filed: Nov. 24, 2020

(65) Prior Publication Data

US 2021/0076814 A1 Mar. 18, 2021

Related U.S. Application Data

(63) Continuation-in-part of application No. 16/540,454, filed on Aug. 14, 2019, now abandoned.

(51) Int. Cl.
*A47B 3/083* (2006.01)
*A47B 3/00* (2006.01)

(52) U.S. Cl.
CPC ..... *A47B 3/083* (2013.01); *A47B 3/002* (2013.01)

(58) Field of Classification Search
CPC ..... A47B 3/002; A47B 3/0803; A47B 13/081; A47B 2200/0036; A47B 1/04; A47B 2001/005; A47B 2003/0806; A47B 83/045; A47B 9/14; A47B 37/00; A47B 2031/003; A47B 2210/0024
USPC .... 108/115, 77–82, 147.19–147.21, 96, 106, 108/107, 110
See application file for complete search history.

(56) References Cited

U.S. PATENT DOCUMENTS 714,545 A * 11/1902 Whitehouse ..... B43L 13/048 33/473
1,516,323 A * 11/1924 Bilton ..... A47B 1/08 108/79
1,777,700 A * 10/1930 Ogburn ..... A47B 1/04 108/78

(Continued)

FOREIGN PATENT DOCUMENTS

DE 3904510 A * 11/1989 ..... A47B 9/14

OTHER PUBLICATIONS

24"x36" Double-sided Mat, Sep. 25, 2017, Omnigrid.com, (Year: 2017).*

(Continued)

*Primary Examiner* — Daniel J Troy
*Assistant Examiner* — Timothy M Ayres
(74) *Attorney, Agent, or Firm* — Elizabeth Yang

(57) ABSTRACT

A collapsible measuring and cutting craft table enables cutting, measuring, and stowing fabric and craft materials from a foldable, height-adjustable, and mobile work surface. The craft table comprises a large, flat work surface having a center panel and two hingedly attached drop leaf panels that fold down for storage. Center support members support the center panel in a horizontal position at the desired working height. Two center support members supports the center panel of the work surface. The outer support members pivot outwardly to a support position to support the drop leaf panels. The outer support members pivot inwardly to a collapsed position to fold the drop leaf panels down perpendicularly relative to the center panel. The center support members telescopically adjust in length to height adjust the work surface. The support members terminates at wheels for mobility. Meshed baskets slide along rails that run between the center support members.

20 Claims, 12 Drawing Sheets

(56) References Cited

U.S. PATENT DOCUMENTS 1,838,352 A * 12/1931 Anderson ..... A47B 9/14 211/208
2,004,296 A * 6/1935 Royce ..... A47B 1/04 312/282
2,010,855 A * 8/1935 Fuller ..... A47B 17/036 108/63
2,039,482 A * 5/1936 Groves ..... A47B 13/00 108/26
3,456,600 A * 7/1969 Sanchez ..... A47B 83/045 108/38
3,520,259 A * 7/1970 Oscoz Sanchez ..... A47B 3/002 108/79
3,855,946 A * 12/1974 Bales ..... A47B 9/14 403/379.3
4,030,200 A * 6/1977 Francis ..... A41H 3/00 33/437
4,588,096 A * 5/1986 Story ..... A47F 5/00 211/126.15
4,795,041 A * 1/1989 Remmers ..... B62B 3/006 211/126.15
5,069,466 A * 12/1991 Propst ..... A47B 31/00 211/186
5,383,723 A * 1/1995 Meyer ..... H02B 1/54 52/655.1
5,829,767 A * 11/1998 Grossman ..... A47B 31/00 280/47.35
6,431,091 B1 * 8/2002 Chang ..... A47B 1/04 108/115
6,467,860 B2 * 10/2002 Remmers ..... A47B 88/402 312/334.7
6,547,264 B1 * 4/2003 Blackburn ..... B62B 5/00 280/47.35
6,663,202 B2 * 12/2003 Spann ..... A61G 12/001 312/249.12
7,140,305 B2 * 11/2006 Christians ..... A47B 3/002 108/115
7,168,373 B1 * 1/2007 Hock ..... A47B 91/02 108/147.11
8,006,858 B2 * 8/2011 Cheng ..... A47B 55/02 220/494
D757,470 S * 5/2016 Pedersen ..... D6/686
10,226,119 B1 * 3/2019 Ko ..... A47B 9/20
2004/0107882 A1 * 6/2004 Zaremski ..... A47B 9/08 108/147.19
2006/0260516 A1 * 11/2006 Chow ..... A61G 13/105 108/14
2007/0001488 A1 * 1/2007 Xiang ..... A47B 5/06 297/140
2011/0315054 A1 * 12/2011 Westbrook ..... A47B 9/20 108/154
2012/0043436 A1 * 2/2012 Atkinson ..... A47B 9/20 248/188.5

OTHER PUBLICATIONS

Shannon Reed, Sullivans Home Hobby Table is My New Favorite, May 16, 2015, quiltersreview.com (Year: 2015).*
Sew Ready Hobby and Fabric Cutting Table, Sep. 2, 2017, walmart.com (Year: 2017).*
Sew Ready Standing Height Craft/Crafting Table Multipurpose Hobby, Jul. 28, 2020, amazon.com , reviews on last page have dates that go back to Apr. 12, 2017 to show sale before Aug. 14, 2017 (Year: 2020).*
Adjustable Home Hobby Table—38431, Apr. 16, 2018, sullivansusa.com (Year: 2018).*

* cited by examiner

COLLAPSIBLE MEASURING AND CUTTING CRAFT TABLE

CROSS-REFERENCE TO RELATED APPLICATIONS

This application is a continuation-in-part patent application of U.S. application Ser. No. 15/563,949 filed on Oct. 2, 2017, which claims priority to a provisional patent application U.S. 62/718,526 filed on Aug. 14, 2018, which are hereby incorporated by reference in their entirety.

FIELD OF THE DISCLOSURE

The present invention generally relates to a collapsible measuring and cutting craft table. More so, the present invention relates to a craft table that enables cutting, measuring, and stowing fabric and craft materials from a foldable, height-adjustable, and mobile work surface; whereby the craft table comprises a large, flat work surface for measuring and cutting fabrics that folds down from opposite drop leaf panels to enable stowage; whereby center support members support the center panel of the work surface in horizontal position at a desired working height above the floor; whereby two center support members supports the center panel of the work surface; whereby the outer support members pivot outwardly to a support position to support the drop leaf panels; whereby the outer support members pivot inwardly to a collapsed position to fold the drop leaf panels down perpendicularly relative to the center panel; whereby the center support members telescopically adjust in length top make the work surface height adjustable; whereby the support members terminates at wheels for mobility; and whereby meshed baskets slide along rails that run between the center support members.

BACKGROUND OF THE DISCLOSURE

Nowadays, measuring and cutting craft tables are commonly used in the current market. The conventional craft tables usually has a large area of working surfaces and a plurality of supporting members to support the working surface. The user can use the craft table to perform crafting, cutting, measuring, or various kinds of technical works. In addition, the conventional craft table has a non-foldable structure, and the volume of the craft table is usually very huge. Therefore, there may exist a desire to develop a compact size and a foldable craft table to satisfy the customer's requirements.

All referenced patents, applications, and literature are incorporated herein by reference in their entirety. Furthermore, where a definition or use of a term in a reference, which is incorporated by reference herein, is inconsistent or contrary to the definition of that term provided herein, the definition of that term provided herein applies and the definition of that term in the reference does not apply. The disclosed embodiments may seek to satisfy one or more of the above-mentioned desires. Although the present embodiments may obviate one or more of the above-mentioned desires, it should be understood that some aspects of the embodiments might not necessarily obviate them.

BRIEF SUMMARY OF THE DISCLOSURE

In a general implementation, a collapsible measuring and cutting craft table, the table comprising:

a work surface comprising a center panel and a plurality of drop leaf panels, the drop leaf panels hingedly attached to the center panel, whereby the drop leaf panels pivot upwardly about the center panel to be coplanar with the center panel, and whereby the drop leaf panels pivot downwardly about the center panel to fold down perpendicularly relative to the center panel;

a plurality of center support members being defined by a center first end that supports the center panel in a horizontal orientation, the center support members further being defined by a center second end;

a plurality of rails traversing the center support members;

a plurality of outer support members disposed parallel to the center support members, the outer support members being defined by an outer first end that supports the drop leaf panels, the outer support members further being defined by an outer second end, the outer support members being pivotable about the center support member, whereby the outer support members pivot outwardly to a support position to support the drop leaf panels, whereby the outer support members pivot inwardly to a collapsed position to enable the drop leaf panels to fold down perpendicularly to the center panel, at least one wheel disposed at the center and outer second ends of the support members; and a height-adjustable lower support panel disposed across the center support members.

In another aspect combinable with the general implementation, at least one of the mesh basket is positioned across the rails, the mesh basket sliding across the rails to detachably join with the center support members.

In another aspect combinable with the general implementation, the meshed basket has a length of about 7.75" and a depth of about 29.5".

In another aspect combinable with the general implementation, the center support members telescopically adjust in length.

In another aspect combinable with the general implementation, the center support members are defined by a plurality of spaced-apart pin holes.

In another aspect combinable with the general implementation, at least one pin is passing through the pin holes, whereby the pin helps fasten the center support members at the desired length. In another aspect combinable with the general implementation, the work surface is defined by a longitudinal length of about 60 inches, and a width between about 30 inches to 39.25 inches.

In another aspect combinable with the general implementation, the work surface comprises medium density fiberboard.

In another aspect combinable with the general implementation, the center panel is about 12 1 h inches or 14 inches wide.

In another aspect combinable with the general implementation, the outer support members comprise two outer support members pivotable about four center support members.

In another aspect combinable with the general implementation, the support members support the work surface has a length of about 36.75 inches.

In another aspect combinable with the general implementation, the support members comprise lightweight aluminum legs.

In another aspect combinable with the general implementation, the support members are powder coated.

In another aspect combinable with the general implementation, the wheels comprises six castor wheels.

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above and below as acting in certain combinations and even initially claimed as such, one or more features from a claimed combination can in some cases be excised from the combination, and the claimed combination may be directed to a subcombination or variation of a subcombination.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

The details of one or more implementations of the subject matter described in this disclosure are set forth in the accompanying drawings and the description below. Other features, aspects, and advantages of the subject matter will become apparent from the description, the drawings, and the claims.

BRIEF DESCRIPTION OF THE DRAWINGS

It should be noted that the drawing figures may be in simplified form and might not be to precise scale. In reference to the disclosure herein, for purposes of convenience and clarity only, directional terms such as top, bottom, left, right, up, down, over, above, below, beneath, rear, front, distal, and proximal are used with respect to the accompanying drawings. Such directional terms should not be construed to limit the scope of the embodiment in any manner.

The invention will now be described, by way of example, with reference to the accompanying drawings, in which:

FIG. 3A shows both drop leaf panels folded down, FIG. 3B shows a left drop leaf panel folded down, and FIG. 3C shows a right drop leaf panel folded down, in accordance with an embodiment of the present invention;

FIG. 5A shows both drop leaf panels folded down, FIG. 5B shows a left drop-leaf panel folded down, and FIG. 5C shows a right drop leaf panel folded down, in accordance with an embodiment of the present invention;

FIG. 7B shows a left drop-leaf panel folded down, and FIG. 7C shows a right drop leaf panel folded down, in accordance with an embodiment of the present invention.

Like reference numerals refer to like parts throughout the various views of the drawings.

DETAILED DESCRIPTION OF THE EMBODIMENTS

The different aspects of the various embodiments can now be better understood by turning to the following detailed description of the embodiments, which are presented as illustrated examples of the embodiments defined in the claims. It is expressly understood that the embodiments as defined by the claims may be broader than the illustrated embodiments described below.

The detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper,' "lower," "left," "rear,' "right," "front," "vertical," "horizontal," and derivatives thereof shall relate to the invention as oriented in FIG. 1.

Furthermore, there is no intention to be bound by any expressed or implied theory presented in the preceding technical field, background, brief summary, or the following detailed description. It is also to be understood that the specific devices and processes illustrated in the attached drawings, and described in the following specification, are simply exemplary embodiments of the inventive concepts defined in the appended claims. Specific dimensions and other physical characteristics relating to the embodiments disclosed herein are therefore not to be considered as limiting unless the claims expressly state otherwise.

Illustrative embodiments of the disclosure are generally directed to a collapsible measuring and cutting craft table 100. The collapsible measuring and cutting craft table 100 is configured to enables cutting, measuring, and stowing fabric 132 and craft materials from a foldable, height-adjustable, and mobile work surface 102. The craft table 100 comprises a large, flat work surface 102 for measuring and cutting fabrics, wherein the flat work surface 102 comprises a center panel 104, and a plurality of drop leaf panels 106*a-b* hingedly connected with the center panel 104, wherein the drop leaf panels 106*a-b* may be folded down from at two opposites of the center panel 104 so as to enable stowage.

Figure 1:
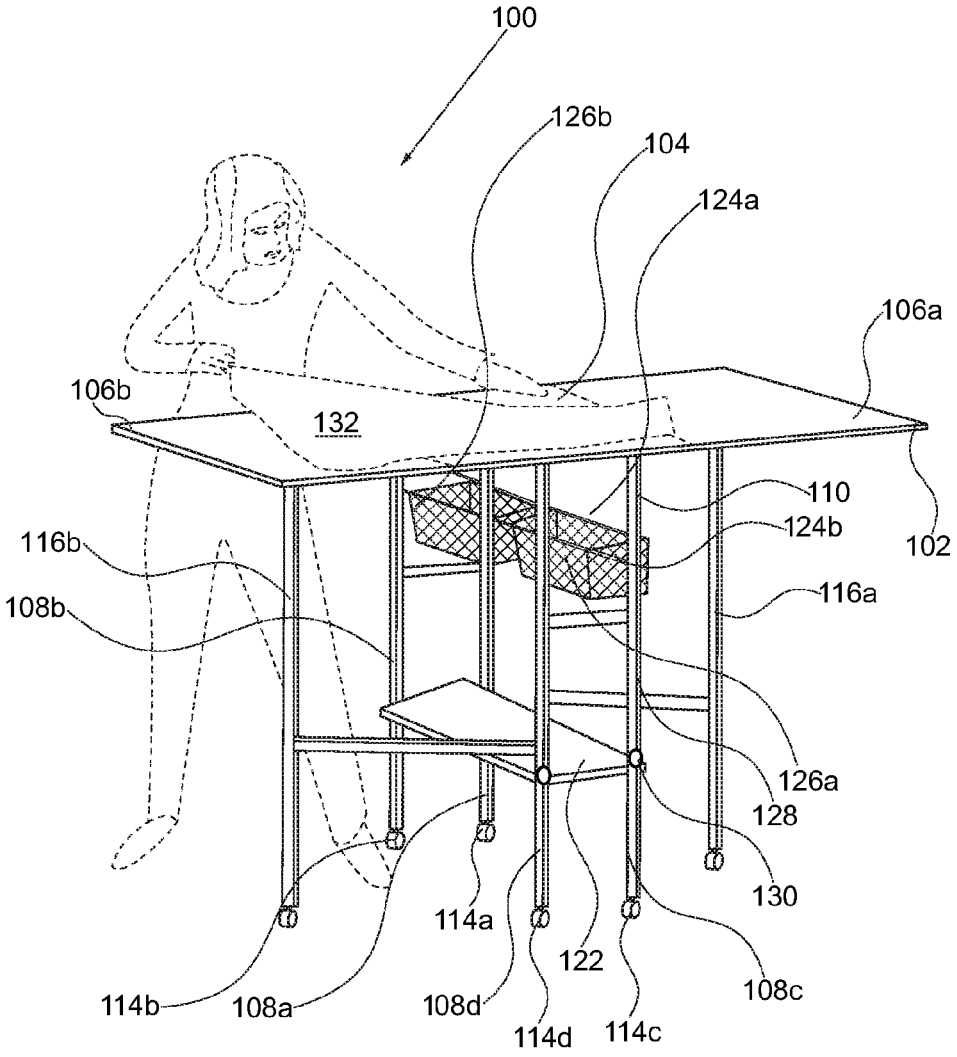
FIG. 1 illustrates a perspective view of an exemplary collapsible measuring and cutting craft table, showing a fabric being measured on a work surface, in accordance with an embodiment of the present invention.

Accordingly, as shown in FIG. 1, the craft table 100 further comprises a plurality of center support members 108*a-d* configured to support the center panel 104 of the work surface 102 in a horizontal position at a desired working height above the floor.

In one embodiment, As referenced in FIG. 1, the craft table 100 may include four center support members 108*a-d* that support the center panel 104 of the work surface 102 in a horizontal orientation, wherein two of the four center support members 108*a-d* are parallelly arranged With each other. The craft table 100 may also comprise two outer support members 116*a-b* that support the drop leaf panels 106*a-b*.

In one aspect, the outer support members 116*a-b* pivot outwardly to a support position to support the drop leaf panels wherein the outer support members 116*a-b* can be pivotally operated with one of the four center support members 108*a-d* to angle at between 0 and 180 degrees. It is worth to mention that the optimal angle between the outer support members 116*a-b* and one of the center support members 108*a-d* is 45 degrees.

Accordingly, each of the outer support members 116*a-b* comprises one end fixedly attached on the one of the drop leaf panels and in this manner, the outer support members 116*a-b* are linked with the drop leaf panels 106*a-b*. In other words, the outer support members 116*a-b* can be outwardly folded to lift up the drop leaf panels 106*a-b* and can be inwardly folded to put down the drop leaf panels 106*a-b*.

In another aspect, the outer support members 116*a-b* may pivot inwardly to a collapsed position to release one or both drop leaf panels 106*a-b* to fold down perpendicularly relative to the center panel 104. The outer support members 116*a-b* can be upwardly folded along the center panel 104 to form the flat work surface 102, and the outer support members 116*a-b* can be downwardly folded to suspend with the center panel 104 for shipping and storage. This selectivity of drop leaf panel operation changes the size of the work surface 102; thereby allowing the user to operate the table in tight spaces, or adjust the size of the work surface to accommodate different fabrics and crafts.

Figure 6:
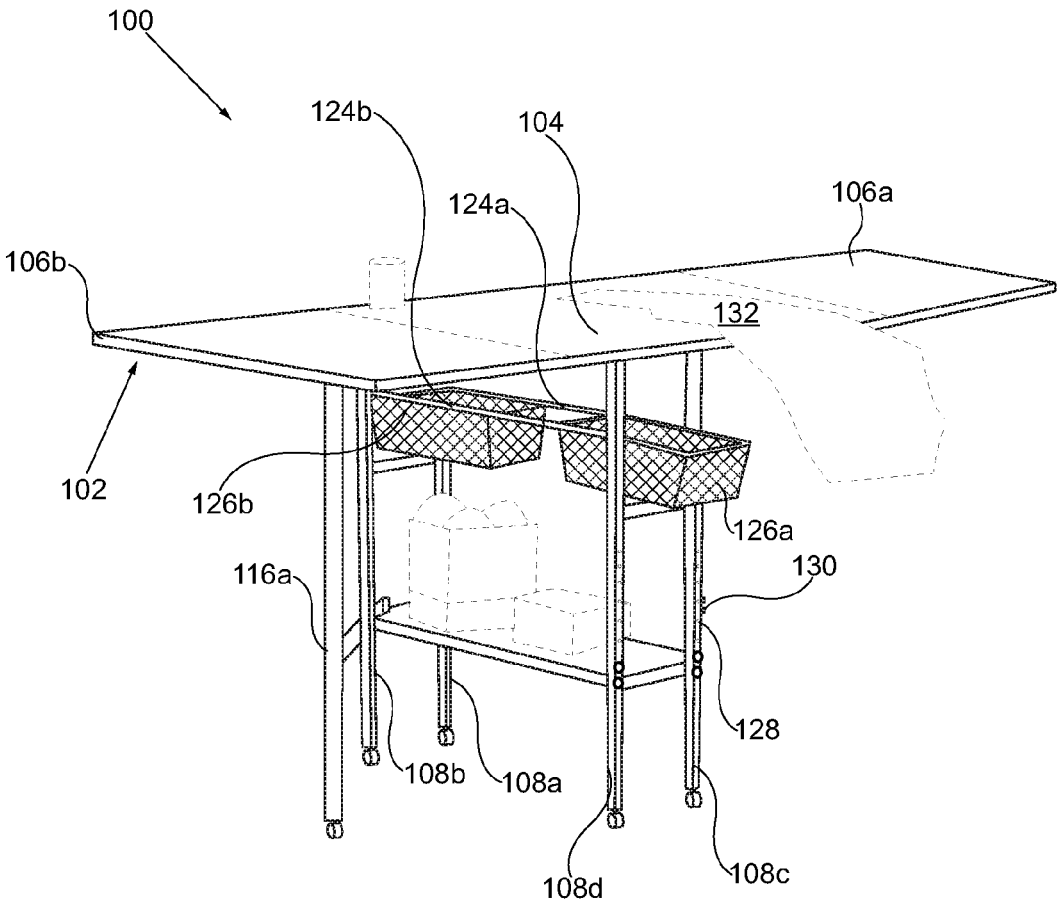
FIG. 6 illustrates a perspective view of the collapsible measuring and cutting craft table shown in FIG. 1, in accordance with an embodiment of the present invention.

Referring to FIG. 6 of the drawings, the center support members 108*a-d* can be telescopically adjusted in length to make the work surface 102 height adjustable. The center support members 108*a-d* may comprise a telescoping configuration that incrementally adjusts in height to enable height adjustability of the work surface 102. In this configuration, the center support members 108*a-d* comprises a plurality of pin holes 128 that align to the desired height, and a plurality of pins 130 that fasten the center support members 108*a-d* at the desired height, wherein the pins 130 are fastened into the pin holes 128 to fasten the center support members 108*a-d* at the desired height.

This adjustable height feature allows a user to stand or sit while working on the work surface 102.

Accordingly, the pin 130 can be inserted into one of the pin holes 128 to retain the craft table 100 at the desired height, wherein each of the pins 130 are located at the same height in order to maintain the work surface 102 at a fixed level.

Figure 8A:
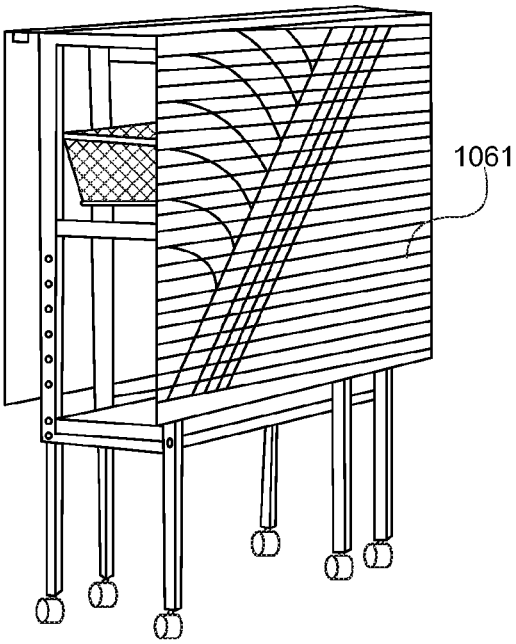
FIG. 8A illustrates a perspective view of a decal grid in accordance with an embodiment of the present invention.
Figure 8B:
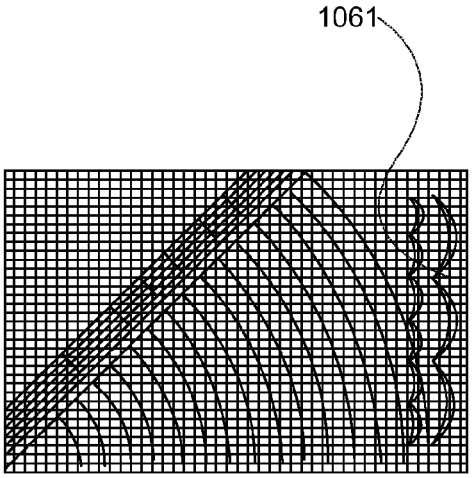
FIG. 8B illustrates a perspective view of the collapsible measuring and cutting craft table, illustrating the decal grid disposed on the drop-leaf panel.
Figure 8C:
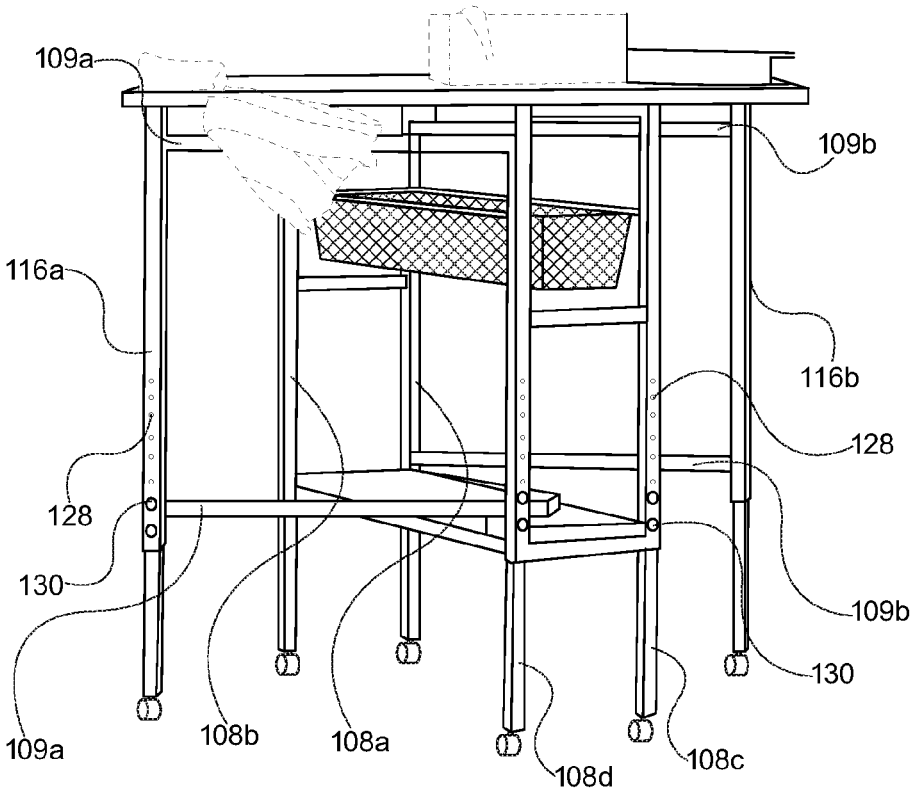
FIG. 8C illustrates a perspective view of the collapsible measuring and cutting craft table.

Referring to FIG. 8C of the drawings, the outer support members 116*a-b* comprises a plurality of holes 128 and a plurality of pins 130 selectively inserted into the holes 128. In one embodiment, each of the pins 130 on the center support members 108*a-d* must be located at the same level as the pins 130 arranged on the outer support members 108*a-d*. For example, in the embodiment of FIG. 8C, all of the pins 130 on the center support members 108*a-d* and the outer support members 116*a-b* may be located at the same level.

In another embodiment, the craft table 100 further comprises a height-adjustable lower support panel 122 that traverses the center support members wherein the height-adjustable lower support panel 122 may be supported by the four center support members 108*a-d* to form a flat surface, so various of objects can be placed thereon. In other words, the lower support panel 122 can be used to provide support for fabrics and craft-related items. The lower support panel 122 is disposed parallel with, and beneath the work surface 102 to store and carry additional items away from the work surface 102. The craft table 100 further includes at least one meshed basket 126*a-b* that slide along rails 124*a-b* that run between the center support members 108*a-d*. Additionally, the support members terminate with at least one wheel 1 14*a-d* to enable mobility.

In one aspect, the work surface 102 may be a rectangular shape and has a longitudinal length of about 60".

In another aspect, the work surface 102 has a width between about 30" to 39.25". In another aspect, the work surface 102 comprises medium density fiberboard.

In yet another aspect, the width of the center panel 104 is 10.75 inches, and the length of the center panel is 36 inches, and the widths of the two drop leaf panels 106*a*-b are the same, which is 24 inches, and the lengths of the two drop leaf panels 106*a-b* are the same, which is 36 inches.

Accordingly, the two drop leaf panels 106*a-b* are rectangular and are identical, and the length of the two drop leaf panels 106*a-b* are identical to the length of the center panel 104, and in this manner, the work surface 102 may be formed by engaging with the two drop leaf panels 106*a-b* and the center panel 104 to form a larger area of rectangular shape.

In another embodiment, the center support members comprise four center support members 108*a-d*, and the outer support members 116*a-b* comprises two outer support members 116*a-b*.

In another aspect, the center support members 108*a-d* support the work surface 102 about 36.75" above a floor.

In another aspect, the center support members 108*a-d* and the outer support members 116*a-d* comprise lightweight aluminum legs.

Referring now to the detail of FIG. 1, the craft table 100 further comprises at least one wheel 114*a-d* having six castor wheels.

In another aspect, the center panel 104 is about 50 pounds, and each of the drop leafs panels 106*a-b* is about 25 pounds. Referring now to the detail of FIG. 6, in yet another aspect, the craft table 100 further comprises meshed baskets 126*a-b*, wherein each of the meshed baskets 126*a-b* has a length of about 7.75" and a depth of about 29.5", and each of the meshed baskets 126*a-b* is about 15 pounds.

In still yet another embodiment, the craft table 100 further comprises at least two rails 124*a-b* extending between the four center support members 108*a-d*, wherein each of the two rails 124*a-b* are supported by two of the center support members 108*a-d*.

In still yet another embodiment, the center support members 108*a-d* and the outer support members 116*a-d* are powder coated.

It is worth to mention that the craft table 100 has a large work surface 102 for cutting, measuring, and stowing fabric 132, wherein the two drop leaf panels 106*a-b* are supported by two elongated, pivoting outer support members 116*a-b*.

Figure 7A:
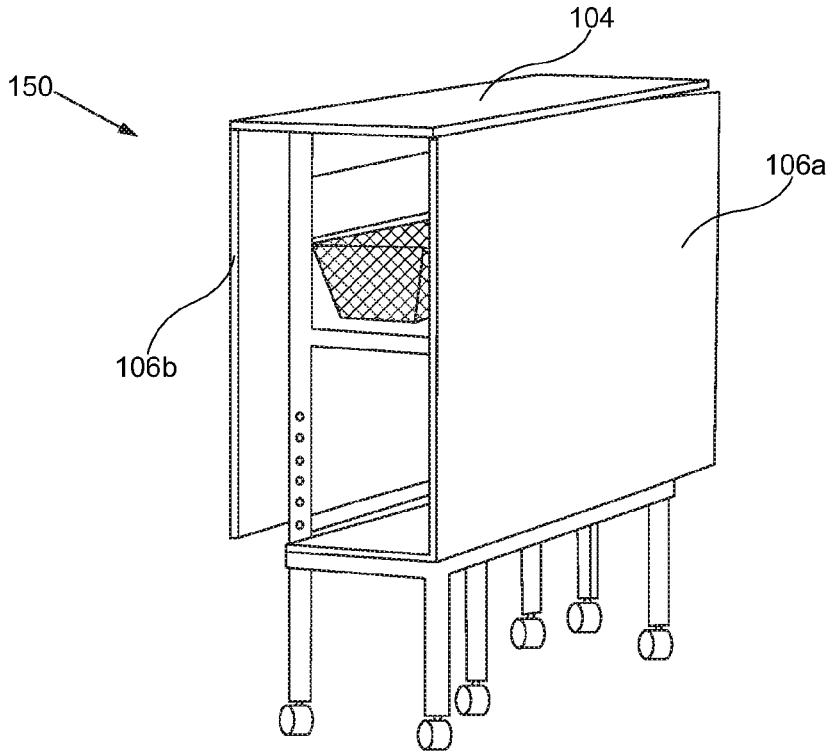
FIGS. 7A-7C illustrate perspective views of the collapsible measuring and cutting craft table, where FIG. 7 A shows both drop leaf panels folded down.

Accordingly, the meshed basket 126*a-b* can be slide out and slide in along two rails 124*a-b* supported on the center support members 108*a-d*, wherein the meshed baskets 126*a-b* can be slide in to entirely located underneath the work surface 102, and two drop leaf panels 106*a-b* can be folded down to overlap with the four center support members 108*a-d*, and at the same time, two outer support members 116*a-b* may be inwardly folded towards the center support members 108*a-d* to overlap with the center support members 108*a-d*, as shown in FIG. 7A. In this manner, the craft table 100 can be formed as a compact rectangular shape in order to facilitate shipping and storage.

Figure 7B:
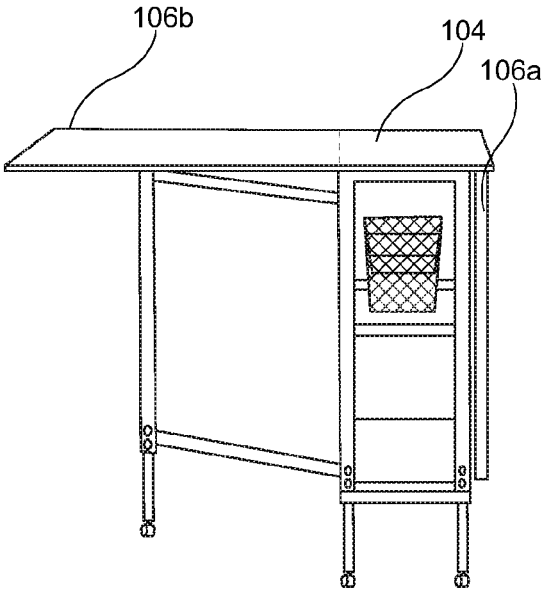

In one embodiment, as shown in FIG. 7B, one of the outer support member 116*a* can be inwardly folded towards the center support members 108*a-d*, and at the same time, one of the drop-leaf panels 106*b* can be downwardly folded towards the center support members 108*a-d* to vertically suspend with the center panel 104, so as to store one of the two drop-leaf panels 106*a*. In this manner, the center panel 104 and one of the drop leaf panels 106*b* are coplanar, so, the user can use the center panel 104 and one of the drop-leaf panels 106*b*.

Figure 7C:
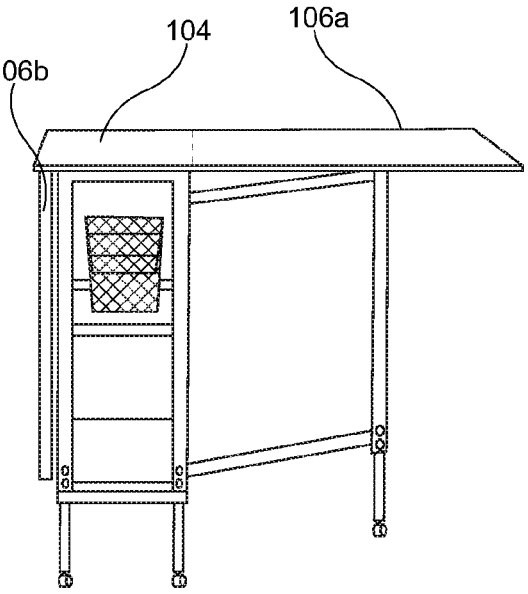

In another embodiment, as shown in FIG. 7C, one of the outer support members 116*b* can be inwardly folded towards the center support members and at the same time, one of the drop-leaf panel 106*a* can be downwardly folded towards the center support members so as to store one of the two drop-leaf panels 106*b*. In this manner, the center panel 104 and one of the drop leaf panels 106*a* are coplanar, so, the user can use the center panel 104 and one of the drop-leaf panels 106*a*.

In yet another embodiment, the craft table 100 further comprises a pair of first connecting members 109*a* and each of the connecting members 109*a* comprises one end pivotally connected with one of the center support members 108*b* and 108*d*, and each of the pair of the connecting members 109*a* comprises an opposite end fixedly connected with one of the outer support members 116*a*. In this manner, one of the outer support members 116*a* can pivotably operated with respect to one of the center support members 108*b* and 108*d* at between zero to 180 degrees.

In other words, the craft table 100 further comprises a pair of second connecting members 109*b*, and each of the connecting members 109*b* comprises one end pivotally connected with one of the center support members 108*a* and 108*c*, and each of the pair of the connecting members 109*b* comprises an opposite end fixedly connected with one of the outer support member 116*b*. In this manner, one of the outer support members 116*b* can pivotably operated with respect to one of the center support members 108*a* and 108*c* at between zero to 180 degrees.

In still yet another embodiment, as shown in FIG. 8A and FIG. 8C, the craft table 100 further comprises a decal grid 1061 selectively disposed on the two drop leaf panels 106*a-b*, and center panel 104 wherein the decal grid 1061 comprises inches and centimeters for convenience.

Although the above embodiments disclose using the inches and centimeters on the decal grid 1061, it should be understood that other types of images or using tools or combination of different types of measuring scales can be used to perform the same function as the present decal grid 1061.

The contemplated embodiment may include a method of folding and unfolding a collapsible measuring and cutting craft table, wherein the method comprises:

upwardly folding at least one drop leaf panels 106*a-b* with respect to a center panel 104 until the drop leaf panels 106*a-b* to be coplanar with the center panel 104;

outwardly unfolding at least one outer support member 116*a-b* with respect to at least one center support member 108*a-d;* inwardly folding the outer support members 116*a-b* towards the center support members 108*a-d*; and downwardly folding the drop leaf panels 106*a-b* towards the center support members 108*a-d*.

In one aspect, each of the outer support members 116*a-b* are pivotally attached to one of the center support members 108*a-d* which support underneath the center panel 104, and the drop-leaf panels 106*a-b* can be folded down perpendicularly to the center panel 104.

In another embodiment, the method further comprises steps of sliding two meshed baskets 126*a-b* along two rails 124*a-b* arranged across the center support members 108*a-d*, wherein the sliding step further comprises steps of:

sliding the meshed baskets 126*a-b* out of the center support members 108*a-d;* sliding the meshed baskets 126*a-b* inside the center support members 108*a-d*.

In yet another embodiment, the step of inwardly folding the outer support members 116*a-b* further comprises a step of: overlapping the outer support members 116*a-b* with the center support members 118*a-d*.

In still yet another embodiment, the step of downwardly folding the drop leaf panels 106*a-b* further comprises a step of: overlapping the drop leaf panels 106*a-b* with the center support members 118*a-d*. A collapsible measuring and cutting craft table 100 is referenced in FIGS. 1-10. The collapsible measuring and cutting craft table 100, hereafter "table 100" is configured for cutting, measuring, and stowing fabric 132 and craft materials from a foldable, height-adjustable, and mobile work surface 102. The table 100 allows a user to stand/sit and work on fabrics and crafts, while also providing the user with ample shelf space means to store fabric 132 cutting and crafting items with ease.

Figure 2:
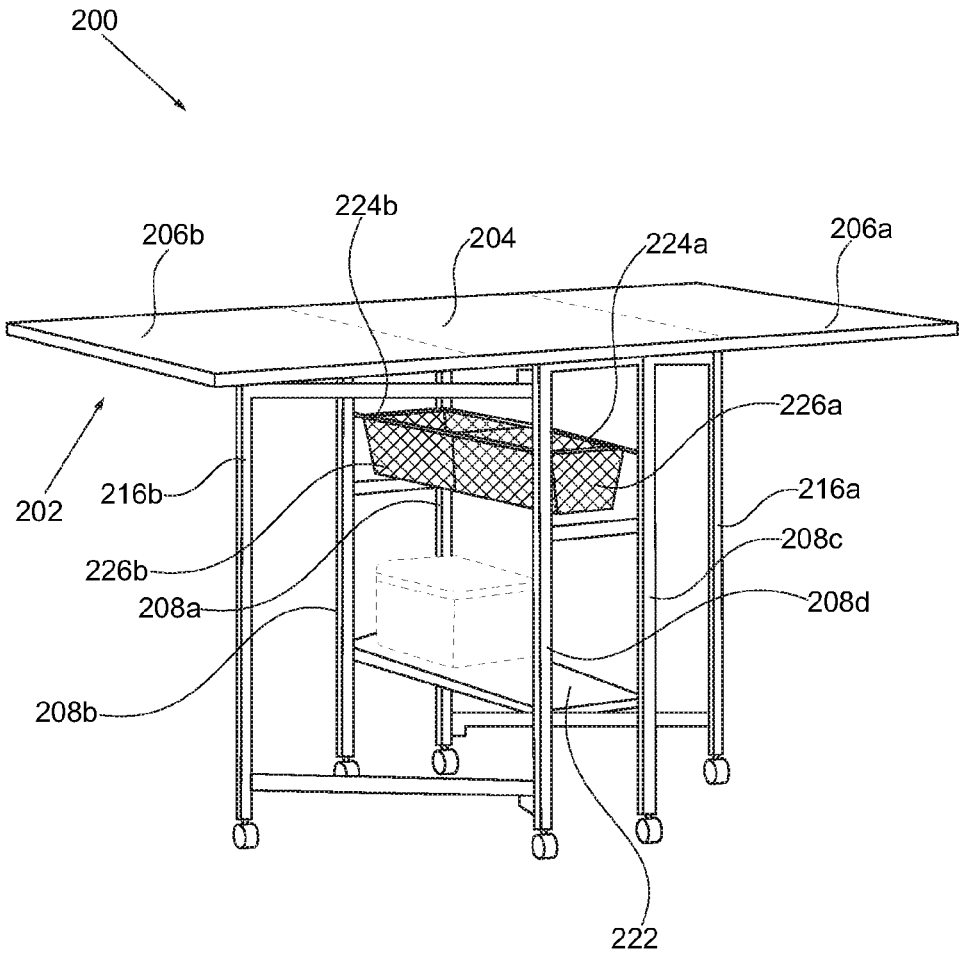
FIG. 2 illustrates a perspective view of a first alternative embodiment of the collapsible measuring and cutting craft table shown in FIG. 1, having a non-adjustable support member length, and two mesh baskets in coplanar alignment, in accordance with an embodiment of the present invention.

As FIG. 1 references, the craft table 100 comprises a large, flat work surface 102. The work surface 102 is sized and dimensioned to enable a user to measure and cut fabrics, and also work on various crafts and art projects. In some embodiments, the work surface 102 may have a rectangular shape. Though other shapes, such as a square or circular shape may be used for the work surface 102. FIG. 1 references a work surface 102 that has a width between about 30" to 39.25", and specific dimensions of 58.75"W× 36" D×30.25"H. Further, FIG. 2 shows, a work surface 202 having a longitudinal length of about 60"W×36" D×30"H.

However, different dimensions are possible. Further, FIG. 4 references a work surface 402 having dimensions of 60"W× 36" D×36.75"H.

The work surface 102 is sufficiently rigid to support the weight of fabrics, cutting tools, and crafts of various types known in the art. Suitable materials for the work surface 102 may include, without limitation, medium-density fiberboard, wood, a rigid polymer, aluminum, metal, and fiberglass. Those skilled in the art will recognize that medium density fiberboard is an engineered wood composite that is similar to particle board but is much denser and stronger than particle board.

In some embodiments, the work surface 102 comprises a center panel 104 and a plurality of drop leaf panels 106*a-b*. The drop leaf panels 106*a-b* hingedly attach to the center panel 104. In this manner, opposite drop leaf panels 106*a-b* can be reconfigured to fold down and reduce the size of the work surface 102, such as to enable stowage. In other words, two drop leaf panels 106*a-b* are hingedly connected at two opposite sides of the center panel 104. Thus, the drop-leaf panels 106*a-b* pivot upwardly about the center panel 104 to be coplanar with the center panel 104. The drop leaf panels 106*a-b* pivot downwardly about the center panel 104 to fold down perpendicularly relative to the center panel 104.

Figure 4:
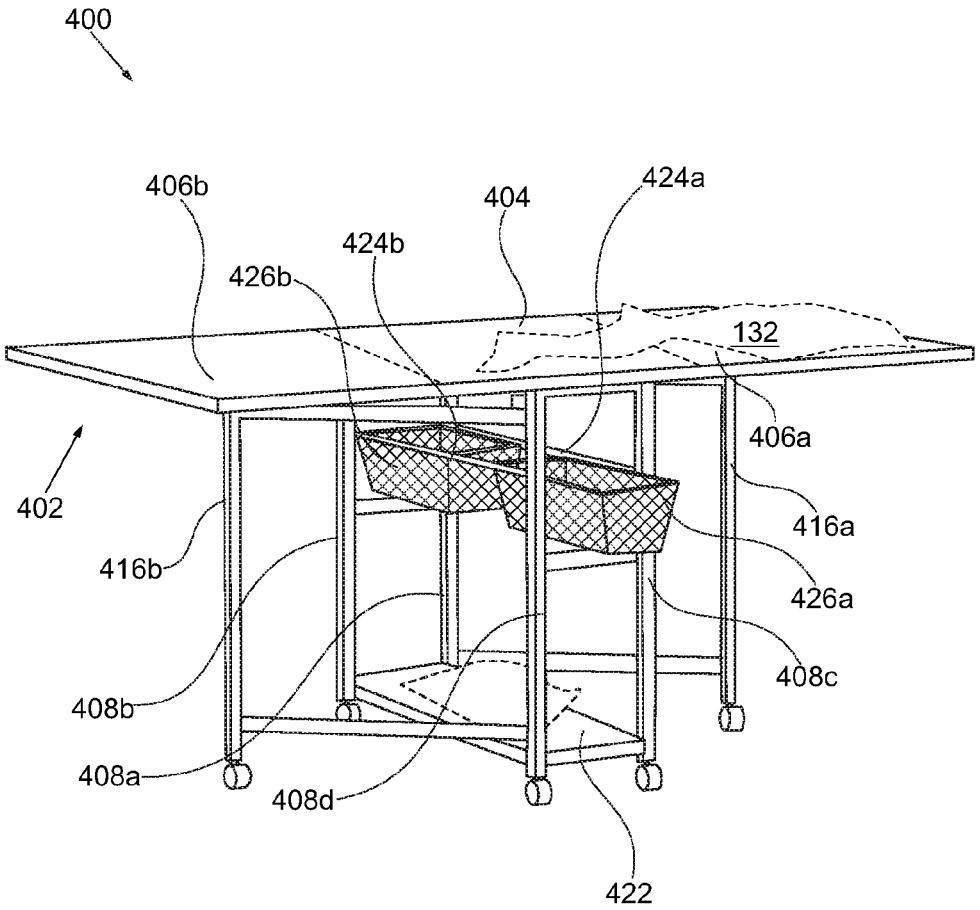
FIG. 4 illustrates a perspective view of a second alternative embodiment of the collapsible measuring and cutting craft table shown in FIG. 1, having a non-adjustable support member length, and a lower shelf panel proximal to the floor, in accordance with an embodiment of the present invention.

Referring now to the detail of FIG. 1, while the two drop leaf panels 106*a-b* are upwardly folded to be coplanar with the center panel 104 while the center panel 104 remains stationary, the work surface 102 is formed by the two drop leaf panels 106*a-b* and the center panels 104. FIG. 1 shows the center panel 104 having dimensions of about 10.75" W×36" D. However, in other embodiments, shown in FIG. 2 shows a center panel 204 having dimensions of about 10.75" W×36" D is possible. FIG. 4 shows a center panel 404 having dimensions of about 12.25" W×36" D. In one non-limiting embodiment, the center panel 104 is about 50 pounds. Though on other embodiments, other weights may be used. As illustrated in FIG. 7A, a plurality of center support members 108*a-d* support the center panel 104 of the work surface 102 in a horizontal position at a desired working height above the floor. The center support members 108*a-d* are defined by a first end 110 that engages the work surface 102, and a second end 112 that rests on the floor.

Looking back at FIG. 1, the center support members 108*a-d* telescopically adjust in length to make the work surface 102 height adjustable. In some embodiments, the center support members 108*a-d* may include a telescoping configuration that incrementally adjusts in height to enable height adjustability of the work surface 102. In this configuration, the center support members 108*a-d* are defined by pin holes 128 that align to a desired height, and a pin 130 that fasten the center support members 108*a-d* at the desired height. For example, in one embodiment, the center support members 108*a-d* support the work surface 102 about 36.75" above a floor. In one non-limiting embodiment, the support members comprise lightweight aluminum legs. In another embodiment, the support members are powder coated.

In one embodiment, the craft table 100 comprises two outer support members 116*a-b* that support the drop leaf panels 106*a-b* of the work surface 102. The outer support members 116*a-b* are defined by a first end 118 that engages the work surface 102, and a second end 120 that rests on the floor. The outer support members 116*a-b* pivot outwardly to a support position to support the drop leaf panels 106*a-b*. The outer support members 16*a-b* are elongated and sufficiently rigid to support the weight of the drop-leaf panels 106*a-b*.

Turning now to FIGS. 7B and 7C, the outer support members 116*a-b* pivot inwardly to a collapsed position to fold the drop leaf panels 106*a-b* down perpendicularly relative to the center panel 104. In one non-limiting embodiment, the drop-leaf panels 106*a-b* are about 25 pounds each. In some embodiments, the support members comprise four central support members and two outer support members 16*a-b* pivotable about the center support members 108*a-d*.

As discussed above, a plurality of outer support members 116*a-b* are disposed parallel to the center support members 108*a-d*. The outer support members 116*a-b* are pivotable about the center support member 108*a-d*. The outer support members 16*a-b* pivot outwardly to a support position to support the drop leaf panels 106*a-b*. Conversely, the outer support members 116*a-b* pivot inwardly to a collapsed position to enable the drop leaf panels 106*a-b* to fold down perpendicularly to the center panel 104.

The support members 108*a-d*, 116*a-b*, terminates with at least one wheel 114*a-d*, which provides mobility for the table 100. In some embodiments, the wheel 114*a-d* is disposed at the center and outer second ends of the support members. In one non-limiting embodiment, the at least one wheel 114*a-d* may include six castor wheels that enable 360° maneuverability.

In some embodiments, a plurality of rails 124*a-b* traverse the center support members 108*a-d*. The rails 124*a-b* provide additional structural integrity, and also support a height-adjustable lower support panel 122, as discussed below. A height-adjustable lower support panel 122 rests across the rails 124*a-b* on the center support members 108*a-d* to provide support for fabrics and craft-related items. The support panel 122 is disposed parallel with and beneath the work surface 102 for storing and carrying items away from the work surface 102.

The craft table 100 further includes at least one meshed basket 126*a-b* that slide along rails 124*a-b* that run between the center support members 108*a-d*. The mesh configuration of the basket allows a user to view the contents inside the mesh basket 126*a-b* without pulling out of the support members 108*a-d*, 116*a-b*. In one embodiment, the meshed basket 126*a-b* has a length of about 7.75" and a depth of about 29.5". In another embodiment, the meshed basket 126*a-b* is about 15 pounds.

As discussed above, there are multiple variations of the craft table 100. The alternative variations are substantially the same: but vary in using different sizes, dimensions, numbers of support members, numbers of drop leaf panels, and mesh baskets. In one example of an alternative table configuration, FIG. 2 shows a first alternative embodiment of a collapsible measuring and cutting craft table 200. In this first alternative embodiment, the table 200 is unique in having a non-adjustable center support member length 208*a-d*, a nonadjustable outer support member length 216*a-b*, and two mesh baskets 226*a-b* slidable across two rails 224*a-b* and in coplanar alignment.

Figure 3A:
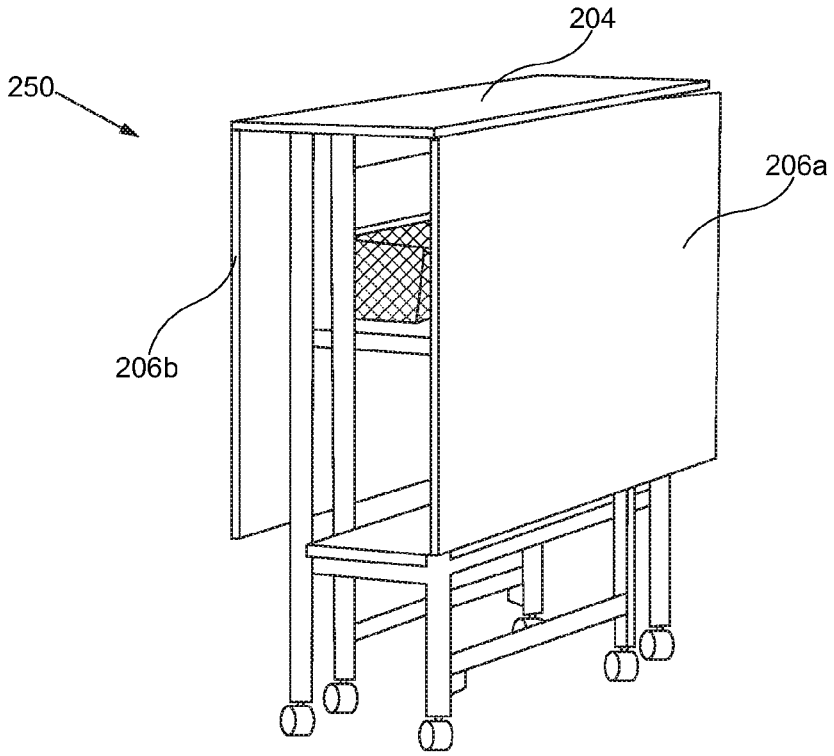
FIGS. 3A-3C illustrate perspective views of the first alternative embodiment of the collapsible measuring and cutting craft table, where
Figure 3B:
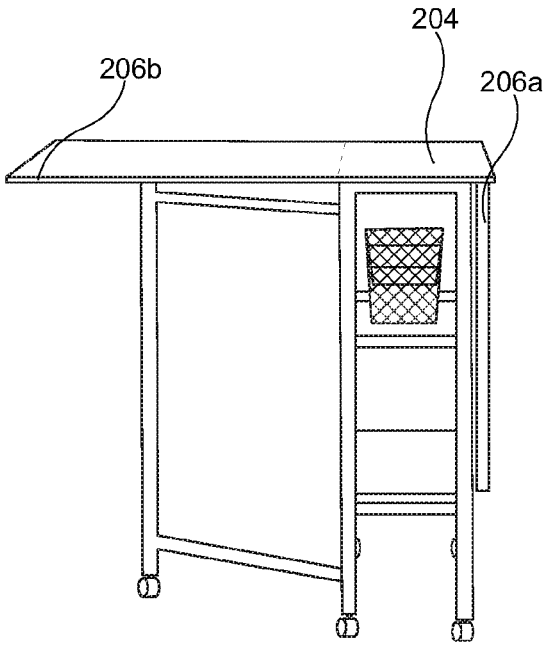
Figure 3C:
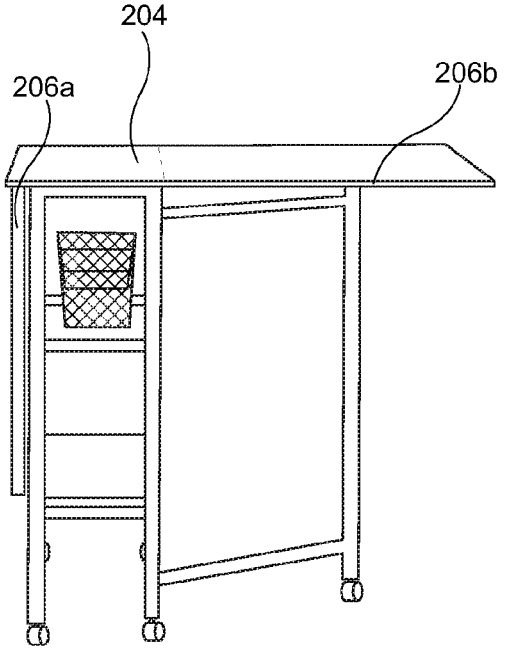

However, the table 200 still utilizes a similar center panel 104, two drop leaf panels 206*a-b*, and two meshed baskets 226*a-b*. FIGS. 3A-3C illustrate perspective views of the first alternative craft table 200, where FIG. 3A shows both drop leaf panels 206*a-b* folded down, FIG. 3B shows a left drop-leaf panel 206*a* folded down, and FIG. 3C shows a right drop leaf 206*b* panel folded down.

FIG. 4 illustrates a perspective view of a second alternative embodiment of a collapsible measuring and cutting craft table 400. In this arrangement, the table 400 is unique in having a non-adjustable center support member length 408*a-d*, a non-adjustable outer support member length 416*a-b*, and two mesh baskets 426*a-b* slidable across two rails 424*ab* and in coplanar alignment. However, the table 400 still utilizes a similar center panel 404, two drop leaf panels 406*a-b*, and two meshed baskets 426*a-b*. However, the table 400 utilizes a lower support panel 422 that is closer to the floor than the above discussed tables 100, 200.

Figure 5A:
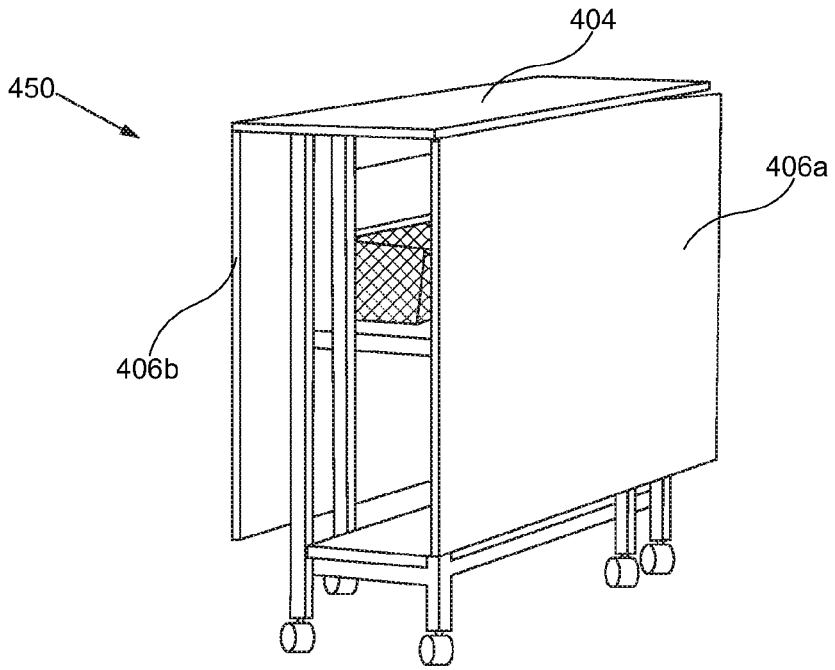
FIGS. 5A-5C illustrate perspective views of the second alternative embodiment of the collapsible measuring and cutting craft table, where
Figure 5B:
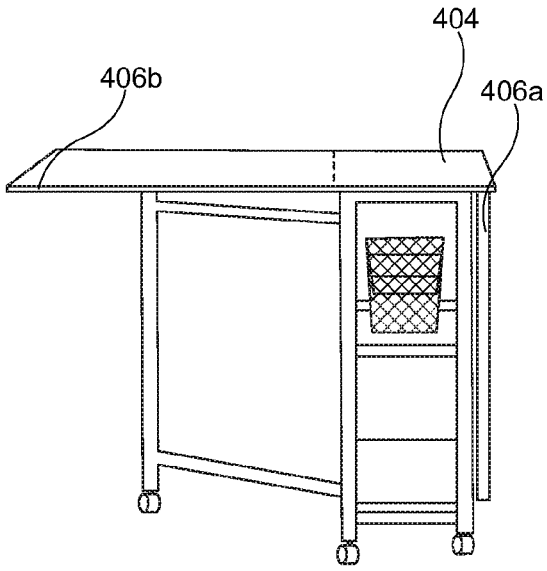
Figure 5C:
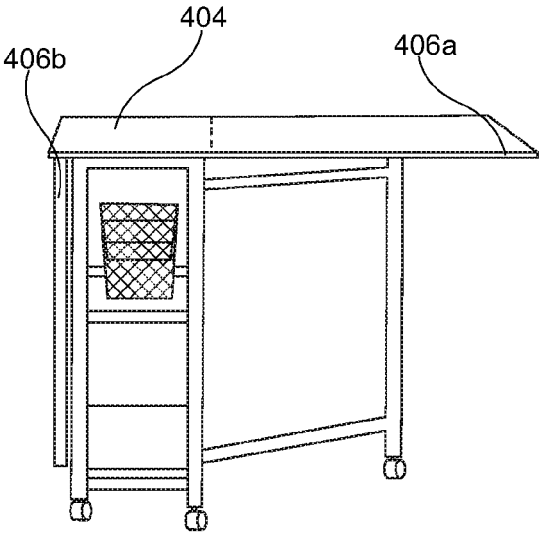

FIGS. 5A-5C illustrate perspective views of the first alternative craft table 400, where FIG. 3A shows both drop leaf panels 406*a-b* folded down, FIG. 5B shows a left drop-leaf panel 406*a* folded down, and FIG. 5C shows a right drop leaf 406*b* panel folded down.

FIG. 6 illustrates a perspective view of the collapsible measuring and cutting craft table shown in FIG. 1. This variation utilizes the adjustable support members 108*a-b*, 116*a-b* that enable a user to stand or sit while cutting and measuring fabric 132 on the work surface 102.

FIGS. 7A-7C illustrate perspective views of the craft table 100, where FIG. 7A shows both drop leaf panels 106*a-b* folded down, FIG. 7B shows a left drop-leaf panel 106*a* folded down, and FIG. 7C shows a right drop leaf panel 106*b* folded down. This selectivity of drop leaf panel operation changes the size of the work surface 102; thereby allowing the user to operate the table 100 in tight spaces, or adjust the size of the work surface to accommodate different fabrics and crafts.

Figure 9:
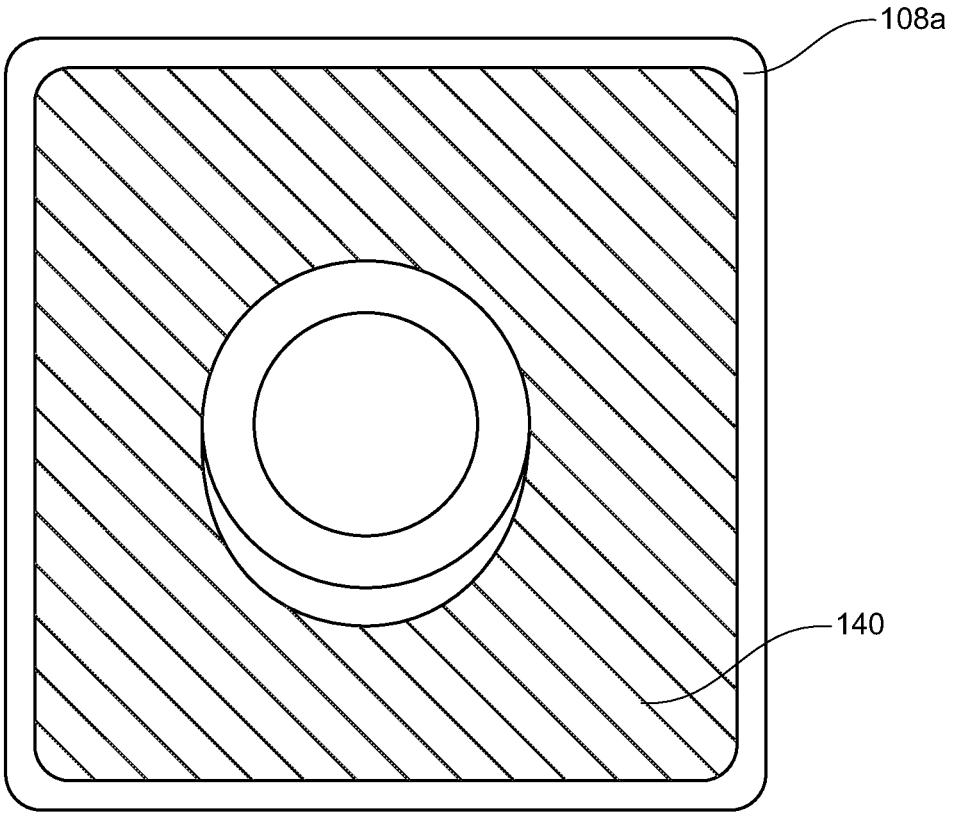
FIG. 9 illustrates a bottom view of the center support member.

In another embodiment, as shown in FIG. 9, there is a plastic filler 140 inside the center support members 108*a-d*, and except for the place where the center support members 108*a-d* are connected with other components and the place for bolt to insert, the plastic filler 140 fills up the center support members 108*a-d*. The plastic filler 140 can also fill up the outer support members 116*a-b*. With the plastic filler 140 inside the center support members 108*a-d* and/or the outer support members 116*a-b*, not only the center support members 108*a-d* and/or the outer support members 116*a-b* will be more stable, but user can also have the caster bolt level and centered, and can easily to put bolt or the pin 130 in the pin hole 128 since there is no additional space inside the center support members 108*a-d* for user to lock the pin 130 or bolt in a bevel angle, user can only lock the pin 130 or bolt in a vertical and straight direction toward the pin hole 128, which make this table 100 easier to assemble and install.

Figure 10:
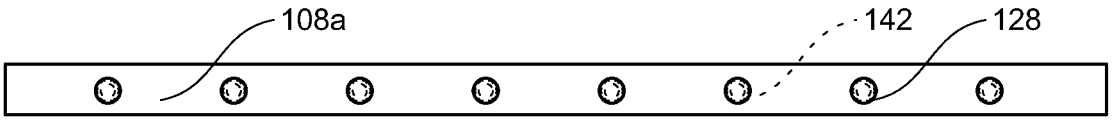
FIG. 10 illustrates a perspective view of part of the center support member.

Furthermore, there is a nut 142 (surrounded by the plastic filler) inside the center support members 108*a-d* and right under each of the pin holes 128, as shown in FIG. 10, to help guide the pin 130 or bolt through the center support members 108*a-d*. This makes it easier for the user to line up and screw-in the pin 130 or bolt to the desired position and makes it easier for user to adjust height of the table 100.

Figure 11:
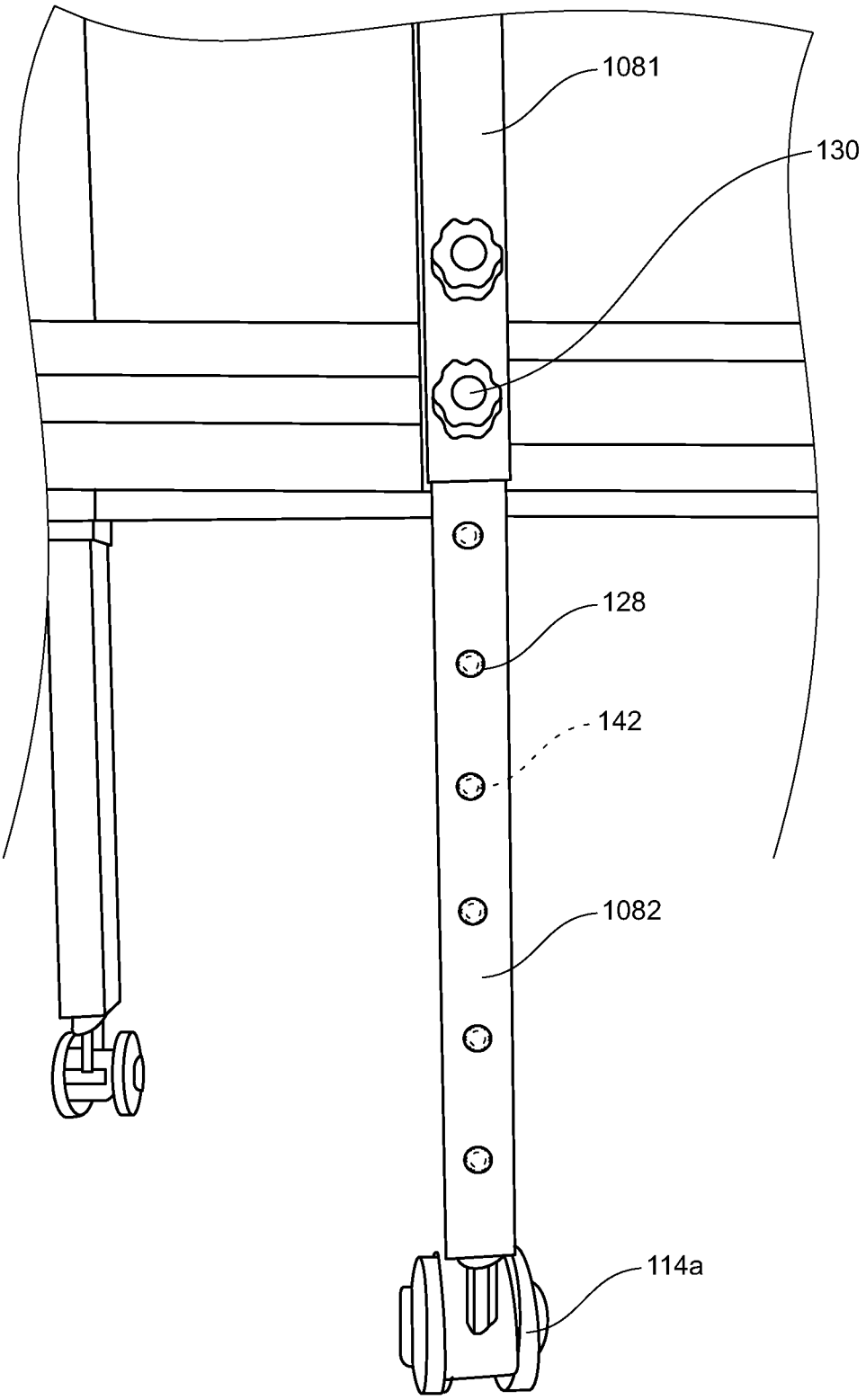
FIG. 11 illustrates a perspective view of the center support member with the wheel.

Overall, FIG. 11 further shows one of the center support members 108*a-d* with the nut 142 secured in each pin hole 128 by the plastic filler 140. This creates a solid connection that reduces wobbling and swaying. Because the inner tube of the center support members 108*a-d* is no longer hollow, the pin 130 can support more weight and distributes the weight inside the center support members 108*a-d* instead of only on their walls, and the pin 130 will always has a nut 142 surrounding it so it does not get stripped.

Thus, the above-mentioned special structure clearly shows that the table 100 does have good practicability and usability, so that the table 100 does have better functions than other tables on the market.

Figure 12:
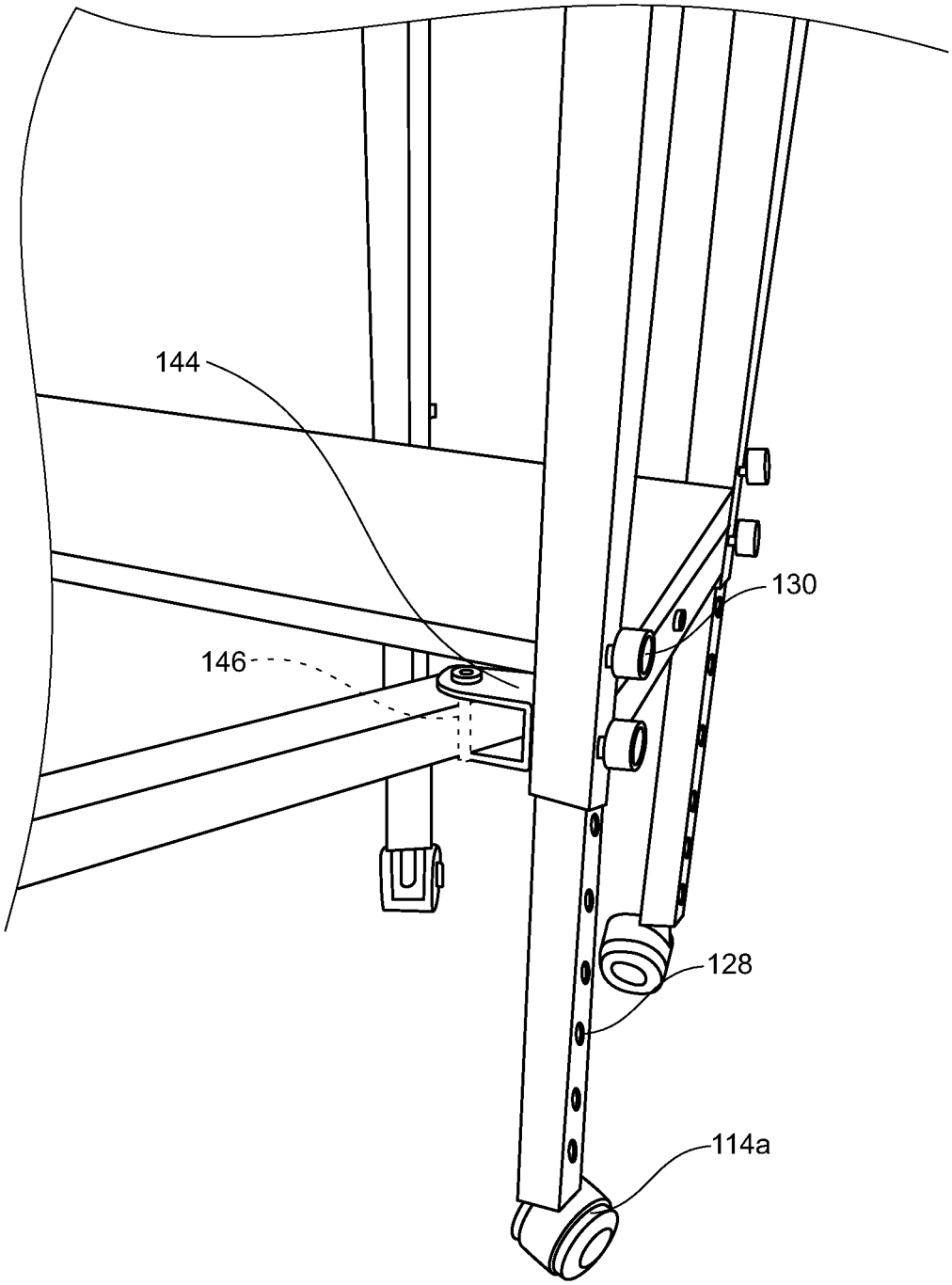
FIG. 12 illustrates a perspective view of the connecting portion between the center support member and the connecting member.
Figure 13:
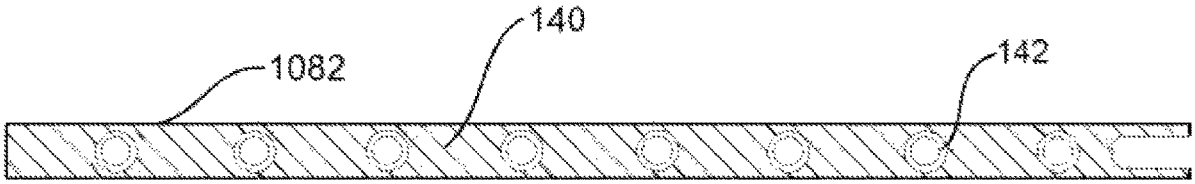

In other or same embodiment mentioned above, as shown in FIG. 12, the table 100 further comprising a C-bracket 144 with a bar 146 in between and the C-bracket 144 is located on each of the center support members 108*a-d* to connect the center support members 108*a-d* with the connecting members 109*a-b*, and each of the connecting members 109*a-b* has a hole (not shown) on one end to let the bar 146 pass through to make one end of the connecting members 109*a-b* pivotally connected with one of the center support members 108*a-d*. Compared to original or traditional connection, the bar 146 still provides the rotating point, but now any wear is not noticed since the contact point between the connecting members 109*a-b* and the center support members 108*a-d* is now inside the C-bracket 144, and the C-bracket 144 has two points of contact which reduces any wobbling. Because the C-bracket 144 has two points of contact and the bar 146 pass through the hole (not shown), the connecting members 109*a-b* won't easily break away from the C-bracket 144, and that also makes the table 100 much safer while using. This makes the rotation of connecting members 109*a-b* much easier and the life span of the components can be expended, which make the table 100 can be used much longer than expected.

In other embodiment, a bolt to the middle of the underside of the center panel 104 is added in order to increase the stability of the center panel 104. In addition, the attachment of the center support members 108*a-d* to the wheels 114*a-d* is improved because a washer is added between the connection of the wheels 114*a-d* and the center support members 108*a-d*, this will make the wheels 114*a-d* has a better connection and stability to the center support members 108*a-d*, which will also make the table 100 more stable for user to use.

In conclusion, a collapsible measuring and cutting craft table 100 enables cutting, measuring, and stowing fabric 132 and craft materials from a foldable, height-adjustable, and mobile work surface 102. The craft table comprises a large, flat work surface having a center panel 104 and two hingedly attached drop leaf panels 106*a-b* that fold down for stowage. Center support members 108*a-d*, 116*a-b* support the center panel in a horizontal position at a desired working height. Two center support members supports the center panel of the work surface. The outer support members pivot outwardly to a support position to support the drop leaf panels. The outer support members pivot inwardly to a collapsed position to fold the drop leaf panels down perpendicularly relative to the center panel. The center support members 108*a-d* telescopically adjust in length to height adjust the work surface. The support members terminate with at least one wheel 114*a-d* for mobility. Meshed baskets 126*a-b* slide along rails that run between the rails 124*a-b* of the center support members 108*a-d*.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims and drawings.

These and other advantages of the invention will be further understood and appreciated by those skilled in the art by reference to the following written specification, claims and appended drawings.

Because many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A collapsible measuring and cutting craft table, the table comprising:

a work surface comprising a center panel and a plurality of drop leaf panels pivotably attached to the center panel, at least three center support members fixedly connected underneath the center panel to support the center panel in a horizontal orientation, and each of the center support members contain an upper outer tube portion and a lower inner tube portion;

a plurality of rails being supported between the center support members;

at least one outer support member located parallel to the center support members and pivotally connected with the center support members; and a height adjustable lower support panel arranged across the center support members;

wherein there is a plastic filler fills inside the lower inner tube portion of the center support members, and being continuous and extending from the lower inner tube portion of the center support members' one end to another end, and the plastic filler has reserved spaces for bolt to insert.

2. The table of claim 1, further comprises a plurality of connecting members and each of the connecting members comprises one end pivotally connected with one of the center support members, and each of the connecting members comprises an opposite end fixedly connected with one of the outer support members.

3. The table of claim 2, further comprising a C-bracket with a bar in between and the C-bracket is located on each of the center support members to connect the center support members with the connecting members, and each of the connecting members has a hole on one end to let the bar pass through to make one end of the connecting members pivotally connected with one of the center support members.

4. The table of claim 3, further comprising at least one wheel attached on each of the center support members and the at least one outer support members to provide mobility for the table.

5. The table of claim 4, further comprising a height adjustable lower support panel arranged across the center support members.

6. The table of claim 5, further comprising at least one mesh basket positioned across the rails, the mesh basket sliding along the rails to detachably join with the center support members.

7. The table of claim 6, wherein the center support members telescopically adjust in length.

8. The table of claim 7, wherein each of the center support members comprises a plurality of spaced-apart pin holes and at least one pin passing through the pin holes to fasten the center support members at the desired level.

9. The table of claim 8, wherein there is a nut inside the center members and right under each of the pin holes.

10. The table of claim 9, wherein each of the drop leaf panels can be vertically suspended with the central panel.

11. The table of claim 10, wherein the center support members and the at least one outer support members comprise lightweight aluminum legs.

12. The table of claim 11, wherein the wheels comprises six castor wheels.

13. A method of folding and unfolding a collapsible measuring and cutting craft table, wherein the craft table comprises a height adjustable lower support panel arranged across at least three center support members, the method comprises:

upwardly folding at least one drop leaf panels with respect to a center panel until the at least one drop leaf panels to be coplanar with the center panel;

outwardly unfolding at least one outer support member with respect to the center support members, and each of the center support members contain an upper outer tube portion and a lower inner tube portion:

inwardly folding the at least one outer support members towards the center support members; and downwardly folding the at least one drop leaf panels towards the center support;

wherein there is a plastic filler fills inside the lower inner tube portion of the center support members, and being continuous and extending from the lower inner tube portion of the center support members' one end to another end, and the plastic filler has reserved spaces for bolt to insert.

14. The method of claim 13, wherein there is a plurality of connecting members and each of the connecting members comprises one end pivotally connected with one of the center support members, and each of the connecting members comprises an opposite end fixedly connected with one of the outer support members; and wherein there is a C-bracket with a bar in between and the C-bracket is located on each of the center support members to connect the center support members with the connecting members, and each of the connecting members has a hole on one end to let the bar pass through to make one end of the connecting members pivotally connected with one of the center support members.

15. The method of claim 13, wherein the at least one outer support members are pivotably attached to the center support members and support underneath the at least one outer support members.

16. The method of claim 15, wherein the at least one drop leaf panels can be folded down perpendicularly to the center panel.

17. The method of claim 13, wherein each of the at least one outer support members can pivotably attached to one of the center support members.

18. The method of claim 13, further comprising sliding two meshed baskets along two rails arranged across the center support members, wherein the sliding step further comprises steps of:

sliding the meshed baskets out of the center support members;

sliding the meshed baskets inside the center support members.

19. The method of claim 18, wherein the step of inwardly folding the outer support members further comprises a step of: overlapping the at least one outer support members with the center support members.

20. The method of claim 19, wherein the step of downwardly folding the at least one drop leaf panels further comprises a step of: overlapping the at least one drop leaf panels with the center support members.

* * * * *